US007413006B2

(12) United States Patent
DeGroot et al.

(10) Patent No.: US 7,413,006 B2
(45) Date of Patent: Aug. 19, 2008

(54) HEADER PLATE FOR USE IN A HEAT EXCHANGER

(75) Inventors: Robert J. DeGroot, Racine, WI (US); Daniel R. DeRosia, Caledonia, WI (US); Gregory M. DaPra, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 324 days.

(21) Appl. No.: 11/398,926

(22) Filed: Apr. 6, 2006

(65) Prior Publication Data

US 2007/0235175 A1 Oct. 11, 2007

(51) Int. Cl.
*F28F 9/04* (2006.01)

(52) U.S. Cl. ..... 165/173

(58) Field of Classification Search ..... 165/173, 165/175, 178

See application file for complete search history.

(56) References Cited

U.S. PATENT DOCUMENTS

| | | | | | |
|---|---|---|---|---|---|
| 1,898,713 | A * | 2/1933 | Carrier et al. | ..... | 165/178 |
| 2,488,627 | A * | 11/1949 | Hisey | ..... | 165/175 |
| 2,573,161 | A * | 10/1951 | Tadewald | ..... | 165/175 |
| 3,245,465 | A * | 4/1966 | Young | ..... | 165/173 |
| 4,465,129 | A * | 8/1984 | Baldensperger et al. | ..... | 165/173 |
| 5,492,172 | A * | 2/1996 | Laveran et al. | ..... | 165/173 |
| 5,676,200 | A * | 10/1997 | Laveran | ..... | 165/173 |
| 5,787,973 | A * | 8/1998 | Kado et al. | ..... | 165/175 |
| 6,082,439 | A * | 7/2000 | Kato et al. | ..... | 165/173 |
| 6,263,570 | B1 | 7/2001 | Cazacu | | |
| 6,446,337 | B1 | 9/2002 | Halm et al. | | |
| 7,156,164 | B2 | 1/2007 | Helms et al. | | |
| 2007/0000657 | A1 * | 1/2007 | Emrich et al. | ..... | 165/173 |

FOREIGN PATENT DOCUMENTS

| | | |
|---|---|---|
| DE | 19757034 | 6/1999 |
| DE | 10016029 | 10/2001 |
| EP | 0990868 | 4/2000 |
| FR | 2764054 | 12/1998 |
| WO | WO 2005/028990 | 3/2005 |

* cited by examiner

*Primary Examiner*—Leonard R Leo
(74) *Attorney, Agent, or Firm*—Michael Best & Friedrich LLP

(57) ABSTRACT

A header plate (20) is provided for receiving the flattened tubes (14) of a heat exchanger. The header plate (20) includes a plurality of tube receiving openings (26), with each of the openings being surrounded by a flange or collar (28) that extends from a base wall (24) of the header plate (20) towards the heat exchanger core (12) to surround the exterior cross section of the associated tube (14). Each of the flanges (28) is shaped to conform to the exterior of the associated tube (14), and a blend radius R is provided at the interface between the base wall (24) and the flange (28). The blend radius R has a size that increases from a radius R1 central to the length of a long side wall (30) of the flange (28) to a radius R2 central to the length of a short side wall (32) of the flange (28).

30 Claims, 3 Drawing Sheets

HEADER PLATE FOR USE IN A HEAT EXCHANGER

FIELD OF THE INVENTION

This invention relates to heat exchangers, and more particularly to heat exchangers that utilize a header plate to receive the ends of flattened heat exchanger tubes for use in distributing the working fluid to and from the interior of the heat exchanger tubes.

BACKGROUND OF THE INVENTION

In heat exchangers that utilize flattened tubes, it is known to provide header plates that have pierced tube receiving openings with flanges or collars surrounding the openings and conforming to the tube ends received in the openings so as to reduce the stress risers at the interfaces between the tubes and the header plate. It is also known for the flanges or collars to either extend into the fluid tank or manifold associated with the header plate or to extend away from (i.e., towards the core of the heat exchanger) the fluid tank or manifold associated with the header plate is attached. While the known designs may have proven adequate for their current applications, there is a continuous push to increase the design limits of heat exchanges in an effort to improve performance, compactness, life, etc., and because of this, there is a continuing need to improve the design of header plates and the associated heat exchangers.

SUMMARY OF THE INVENTION

In accordance with one feature of the invention, a header plate is provided for receiving the flattened tubes of a heat exchanger core, each of the flattened tubes having an exterior cross section defined by a pair of broad side walls joined by a pair of shorter nose walls. The header plate includes a planar base wall, and a plurality of tube receiving openings in the base wall, each of the openings surrounded by a flange (collar) extending from the base wall towards the core to surround the exterior cross section of a flattened tube received in the opening. The flange is shaped to conform to the exterior cross section and has a pair of long side walls that conform to the broad side walls of the flattened tube and a pair of short side walls that conform to the nose walls of the flattened tube. A blend radius R1 is provided at the interface between a central portion of each of the long side walls and the base wall. A blend radius R2 is also provided at the interface between each of the short side walls and the base wall. R2 is in the range of 1.25×R1 to 5×R1.

In one feature of the invention, a header plate is provided for receiving the flattened tubes of a heat exchanger core, each of the flattened tubes having an exterior cross section defined by a pair of broad side walls joined by a pair of shorter nose walls. The header plate includes a planar base wall, and a plurality of tube receiving openings in the base wall, each of the openings surrounded by a flange (collar) extending from the base wall towards the core to surround the exterior cross section of a flattened tube received in the opening. The flange is shaped to conform to the exterior cross section and has a pair of long side walls that conform to the broad side walls of the flattened tube and a pair of short side walls that conform to the nose walls of the flattened tube. A blend radius is provided at the interface between the flange and the base wall, the blend radius having a size that increases from a radius R1 central to the length of the long side walls to a radius R2 central to he length of the short side walls, with R2 being in the range of 1.25×R1 to 5×R1.

In accordance with one feature of the invention, a heat exchanger includes a header plate, and a plurality of spaced, parallel, flattened tubes, each of the tubes having an exterior cross section defined by a pair of broad side walls joined by a pair of shorter nose walls. The header plate includes a planar base wall, and a plurality of tube receiving openings in the base wall, each of the openings surrounded by a flange (collar) extending from the base wall towards the core to surround the exterior cross section of a flattened tube received in the opening. The flange is shaped to conform to the exterior cross section and has a pair of long side walls that conform to the broad side walls of the flattened tube and a pair of short side walls that conform to the nose walls of the flattened tube. A blend radius R1 is provided at the interface between a central portion of each of the long side walls and the base wall. A blend radius R2 is also provided at the interface between each of the short side walls and the base wall. R2 is in the range of 1.25×R1 to 5×R1.

According to one feature of the invention, a heat exchanger includes a header plate, and a plurality of spaced, parallel, flattened tubes, each of the tubes having an exterior cross section defined by a pair of broad side walls joined by a pair of shorter nose walls. The header plate includes a planar base wall, and a plurality of tube receiving openings in the base wall, each of the openings surrounded by a flange (collar) extending from the base wall towards the core to surround the exterior cross section of a flattened tube received in the opening. The flange is shaped to conform to the exterior cross section and has a pair of long side walls that conform to the broad side walls of the flattened tube and a pair of short side walls that conform to the nose walls of the flattened tube. A blend radius is provided at the interface between the flange and the base wall, the blend radius having a size that increases from a radius R1 central to the length of the long side walls to a radius R2 central to the length of the short side walls, with R2 being in the range of 1.25×R1 to 5×R1.

As one feature of the invention, a header plate is provided for receiving the flattened tubes of a heat exchanger core, each of the flattened tubes having an exterior cross section defined by a pair of broad side walls joined by a pair of shorter nose walls. The header plate includes a planar base wall, and a plurality of tube receiving openings in the base wall, each of the openings surrounded by a flange (collar) extending from the base wall towards the core to surround the exterior cross section of a flattened tube received in the opening. The flange is shaped to conform to the exterior cross section and has a pair of long side walls that conform to the broad side walls of the flattened tube and a pair of short side walls that conform to the nose walls of the flattened tube. The broad side walls are flared away from each other as they extend away from the base wall and a blend radius R1 is provided at the interface between a central portion of each of the long side walls and the base wall. A blend radius R2 is also provided at the interface between each of the short side walls and the base wall. R2 is in the range of 1.25×R1 to 5×R1.

In one feature of the invention, a header plate is provided for receiving the flattened tubes of a heat exchanger core, each of the flattened tubes having an exterior cross section defined by a pair of broad side walls joined by a pair of shorter nose walls. The header plate includes a planar base wall, and a plurality of tube receiving openings in the base wall, each of the openings surrounded by a flange (collar) extending from the base wall towards the core to surround the exterior cross section of a flattened tube received in the opening. The flange is shaped to conform to the exterior cross section and has a pair of long side walls that conform to the broad side walls of the flattened tube and a pair of short side walls that conform to the nose walls of the flattened tube. The broad side walls are flared away from each other as they extend away from the base wall and a blend radius is provided at the interface between the flange and the base wall, the blend radius having a size that increases from a radius R1 central to the length of the long side walls to a radius R2 central to he length of the short side walls, with R2 being in the range of 1.25×R1 to 5×R1.

In accordance with one feature of the invention, a heat exchanger includes a header plate, and a plurality of spaced, parallel, flattened tubes, each of the tubes having an exterior cross section defined by a pair of broad side walls joined by a pair of shorter nose walls. The header plate includes a planar base wall, and a plurality of tube receiving openings in the base wall, each of the openings surrounded by a flange (collar) extending from the base wall towards the core to surround the exterior cross section of a flattened tube received in the opening. The flange is shaped to conform to the exterior cross section and has a pair of long side walls that conform to the broad side walls of the flattened tube and a pair of short side walls that conform to the nose walls of the flattened tube. The broad side walls are flared away from each other as they extend away from the base wall and a blend radius R1 is provided at the interface between a central portion of each of the long side walls and the base wall. A blend radius R2 is also provided at the interface between each of the short side walls and the base wall. R2 is in the range of 1.25×R1 to 5×R1.

According to one feature of the invention, a heat exchanger includes a header plate, and a plurality of spaced, parallel, flattened tubes, each of the tubes having an exterior cross section defined by a pair of broad side walls joined by a pair of shorter nose walls. The header plate includes a planar base wall, and a plurality of tube receiving openings in the base wall, each of the openings surrounded by a flange (collar) extending from the base wall towards the core to surround the exterior cross section of a flattened tube received in the opening. The flange is shaped to conform to the exterior cross section and has a pair of long side walls that conform to the broad side walls of the flattened tube and a pair of short side walls that conform to the nose walls of the flattened tube. The broad side walls are flared away from each other as they extend away from the base wall and a blend radius is provided at the interface between the flange and the base wall, the blend radius having a size that increases from a radius R1 central to the length of the long side walls to a radius R2 central to the length of the short side walls, with R2 being in the range of 1.25×R1 to 5×R1.

In one feature, R2 is at least equal to or greater than 2×R1.

As one feature, R2 is at least 3.0 mm.

According to one feature, the base wall has a thickness of about 2.5 mm, the walls of the flange have a thickness of about 0.71 mm, R1 is about 1.5 mm, R2 is about 3 mm, and the flange has a height above the base wall in the range of about 7.0 mm to about 6.2 mm.

In accordance with one feature, a blend radius $R_T$ is provided at the interface between the base wall and portions of each of the long side walls adjacent the short side walls, the blend radius $R_T$ decreasing from R2 to R1 as the interface extends from corresponding short side wall toward the central portion of the corresponding long side wall.

Other objects, features, and advantages of the invention will become apparent from a review of the entire specification, including the appended claims and drawings.

DETAILED DESCRIPTION OF THE PREFERRED EMBODIMENTS

Figure 1:
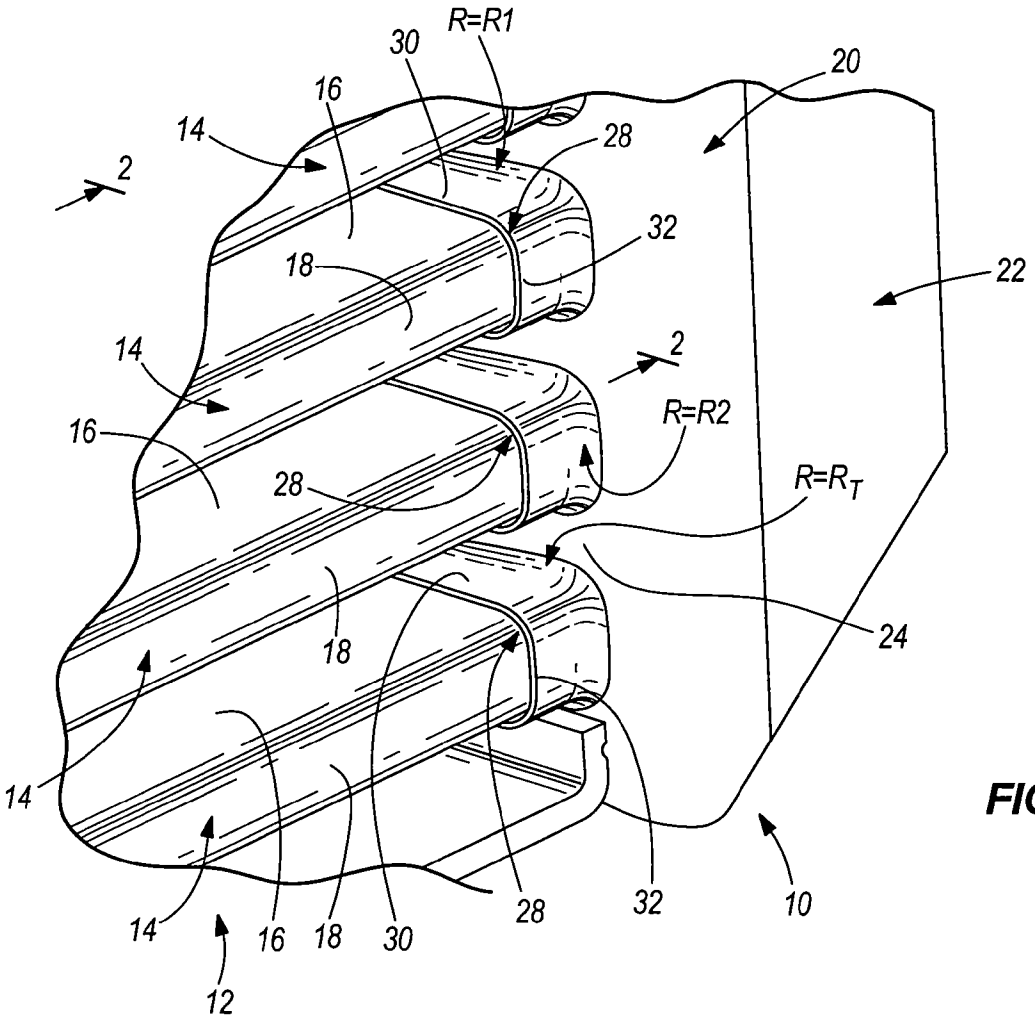
FIG. 1 is a partial, perspective view of a heat exchanger including a header plate embodying the present invention.
Figure 2:
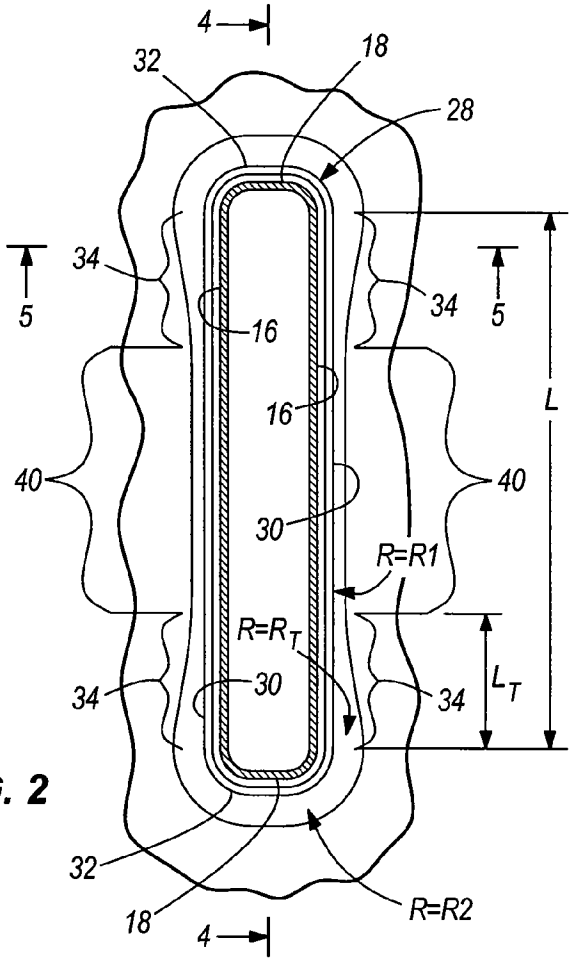
FIG. 2. is a view taken from line 2-2 in FIG. 1.

With reference to FIGS. 1 and 2, part of a heat exchanger 10 is shown and includes a heat exchanger core 12 made up of a plurality of flattened tubes 14 each having an exterior cross section defined by a pair of broad side walls 16 joined by a pair of shorter nose walls 18. A header plate 20 is provided for receiving the flattened tubes 14 to distribute the working fluid of the heat exchanger between the interiors of the tubes and a fluid tank or manifold 22 associated with the header plate 20. While not shown in the drawings, it should be appreciated that the heat exchanger core 12 may include suitable fins, such as serpentine or corrugated fins, or plate fins that extend between the tubes 14.

Figure 3:
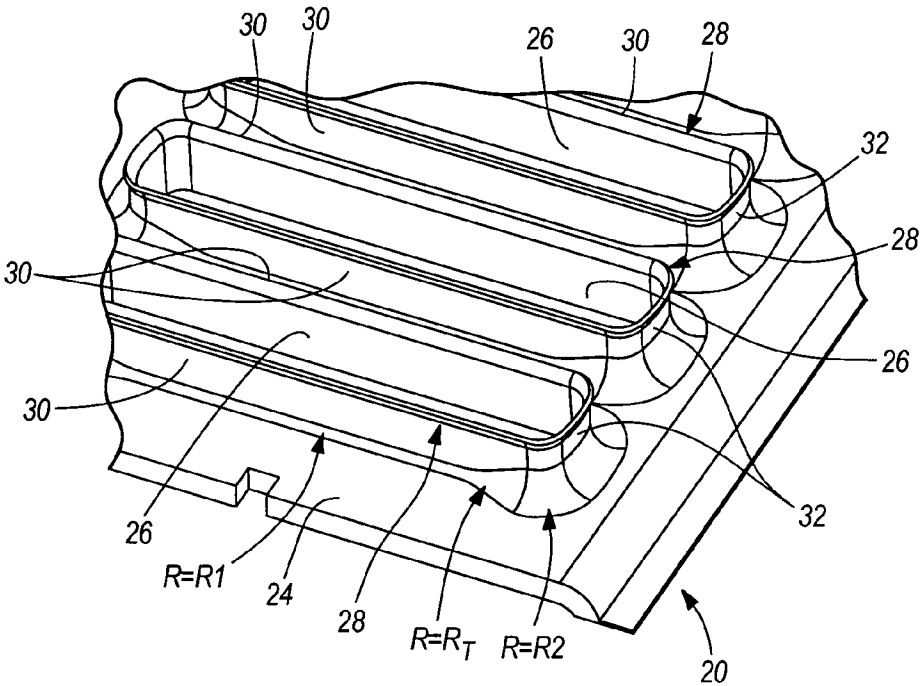
FIG. 3 is an enlarged perspective view showing part of the header plate embodying the present invention.
Figure 4:
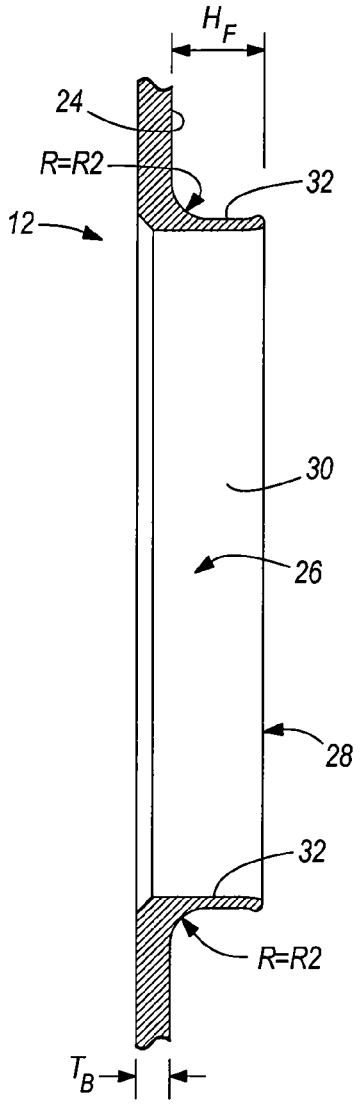
FIG. 4 is a view taken from line 4-4 in FIG. 2, with the heat exchanger tube removed.
Figure 5:
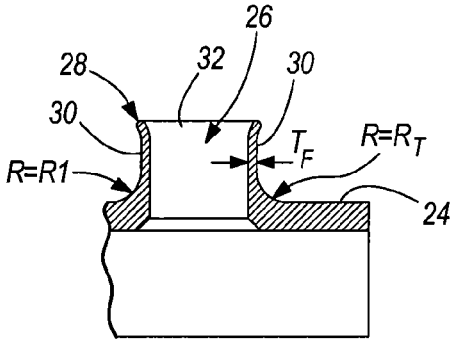
FIG. 5 is a view taken from line 5-5 in FIG. 2, with the heat exchanger tube removed.

As best seen in FIGS. 3-5, the header plate 20 is preferably formed from a single piece of material and includes a planar base wall 24 and a plurality of tube receiving openings 26 in the base wall 24. Each of the openings 26 is surrounded by a flange or collar 28 that extends from the base wall 24 towards the core 12 to surround the exterior cross section of the flattened tube 14 that is received in the opening 26. As best seen in FIGS. 1 and 2, each of the flanges 28 is shaped to conform to the exterior of the associated flattened tube 14 and has a pair of long side walls 30 that conform to the broad side walls 16 of the tube 14 and a pair of short side walls 32 that conform to the nose walls 18 of the flattened tube 14.

As best seen in FIGS. 3-5, a blend radius R is provided at the interface between the base wall 24 and each of the flanges 28, with the blend radius R having a size that increases from a radius R1 central to the length of the long side walls 30 to a radius R2 central to the length of the short side walls 32. Preferably, the blend radius R2 is provided at the interface between the flange 28 and the base wall 24 over the entire length of each of the short side walls 32, and there is a transition zone 34 that extends over portions of each of the long side walls 30 adjacent the short side walls 32, with a blend radius $R_T$ that decreases from R2 to R1 as the interface extends from the corresponding short side wall 32 toward a central portion 40 of the corresponding long side wall 30 that has a blend radius of R1. Preferably, the transition zone 34 has a length $L_T$ along each of the broad side walls 30 that is in the range of ⅛ to ⅓ the total length L of the corresponding long side wall 30, and in highly preferred embodiments is in the range of ¼ to 3/11 of the total length L of the corresponding long side wall 30. However, in some applications, it may be desirable for the transition zone 34 to be very abrupt, or in other applications to extend almost completely to the center of the corresponding long side wall 30.

Preferably, R2 is in the range of 1.25×R1 to 5×R1 and, in one highly preferred embodiment, analysis has shown that R2 should be equal to about 2×R1. In one very specific embodiment, the base wall 24 has a thickness $T_B$ of about 2.5 mm (0.098 inch), the walls 30 and 32 of the flange 28 have a thickness $T_F$ of about 0.71 mm (0.028 inch), R1 is about 1.5 mm (0.059 inch), R2 is about 3 mm (0.12 inch), and the flange 28 has a height $H_F$ above the base wall 24 in the range of about 7 mm (0.28 inch) to about 6.2 mm (0.24 inch). As used herein, the terms "about" or "nominally" are intended to indicate a range around the stated number that is generated by the conventional tolerances associated with the manufacturing technique used to make the header plate 20.

Preferably, the header plate 20 is formed using known pierce/flange stamp tooling methods wherein the opening 26 is pierced and then the flange 28 is formed using suitable stamp tooling. It is also preferred that the header plate be made of a suitable aluminum material. However, in some applications it may be desirable to utilize other manufacturing methods and other materials for the header plate 20.

Figure 6:
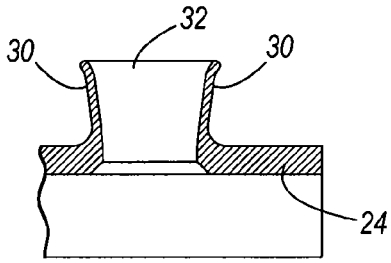
FIG. 6 is a view similar to FIG. 5, but showing a modified version of the header.

With reference to FIG. 6, one possible modification of the header plate is shown wherein each of the flanges 28 is modified so that the side walls 30 flare away from each other as they extend away from the base wall 24 so as to provide a lead-in for the corresponding tube 14 during assembly of the tube 14 with the header plate 20. Preferably, this flaring is provided over almost the entire length L of each of the long side walls 30.

It has been determined through analysis that by varying the blend radius R at the interface between the flange 28 and the base wall 24, an improved distribution of thermal and pressure loads can be achieved at the tube to header joint, and can also result in improved thermal and pressure life cycles for the header plate 20 and the associated heat exchanger 10. Furthermore, when the header plate 20 is formed by piercing the openings 26 and using stamp tooling methods to form the flange 28, the variations in the blend radius R as described above tends to limit or prevent cracking or tearing of the material of the header plate 20 during formation of the flanges 28.

The invention claimed is:

1. A header plate for receiving the flattened tubes of a heat exchanger core, each of the flattened tubes having an exterior cross section defined by a pair of broad side walls joined by a pair of shorter nose walls, the header plate comprising:

a planar base wall; and a plurality of tube receiving openings in the base wall, each of the openings surrounded by a flange extending from the base wall towards the core to surround the exterior cross section of a flattened tube received in the opening, the flange being shaped to conform to said exterior cross section and having a pair of long side walls that conform to the broad side walls of the flattened tube and a pair of short side walls that conform to the nose walls of the flattened tube, wherein a blend radius R1 is provided at the interface between a central portion of each of the long side walls and the base wall, a blend radius R2 is provided at the interface between each of the short side walls and the base wall, and R2 is in the range of 1.25×R1 to 5×R1.

2. The header plate of claim 1 wherein R2 is at least equal to or greater than 2×R1.

3. The header plate of claim 1 wherein R2 is at least 3.0 mm.

4. The header plate of claim 1 wherein the base wall has a thickness of about 2.5 mm, the walls of the flange have a thickness of about 0.71 mm, R1 is about 1.5 mm, R2 is about 3 mm, and the flange has a height above the base wall in the range of about 7.0 mm to about 6.2 mm.

5. The header plate of claim 1 wherein a blend radius $R_T$ is provided at the interface between the base wall and portions of each of the long side walls adjacent the short side walls, the blend radius $R_T$ decreasing from R2 to R1 as the interface extends from corresponding short side wall toward the central portion of the corresponding long side wall.

6. A header plate for receiving the flattened tubes of a heat exchanger core, each of the flattened tubes having an exterior cross section defined by a pair of broad side walls joined by a pair of shorter nose walls, the header plate comprising:

a planar base wall; and a plurality of tube receiving openings in the base wall, each of the openings surrounded by a flange extending from the base wall towards the core to surround the exterior cross section of a flattened tube received in the opening, the flange being shaped to conform to said exterior cross section and having a pair of long side walls that conform to the broad side walls of the flattened tube and a pair of short side walls that conform to the nose walls of the flattened tube, wherein a blend radius is provided at the interface between the flange and the base wall, the blend radius having a size that increases from a radius R1 central to the length of the long side walls to a radius R2 central to the length of the short side walls, with R2 being in the range of 1.25×R1 to 5×R1.

7. The header plate of claim 6 wherein R2 is at least equal to or greater than 2×R1.

8. The header plate of claim 6 wherein R2 is at least 3.0 mm.

9. The header plate of claim 6 wherein the base wall has a thickness of about 2.5 mm, the walls of the flange have a thickness of about 0.71 mm, R1 is about 1.5 mm, R2 is about 3 mm, and the flange has a height above the base wall in the range of about 7.0 mm to about 6.2 mm.

10. A heat exchanger comprising:

a plurality of spaced, parallel, flattened tubes, each of the tubes having an exterior cross section defined by a pair of broad side walls joined by a pair of shorter nose walls; and a header plate comprising:

a planar base wall; and a plurality of tube receiving openings in the base wall, each of the openings surrounded by a flange extending from the base wall towards the core to surround the exterior cross section of a flattened tube received in the opening, the flange being shaped to conform to said exterior cross section and having a pair of long side walls that conform to the broad side walls of the flattened tube and a pair of short side walls that conform to the nose walls of the flattened tube, wherein a blend radius R1 is provided at the interface between a central portion of each of the long side walls and the base wall, a blend radius R2 is provided at the interface between each of the short side walls and the base wall, and R2 is in the range of 1.25×R1 to 5×R1.

11. The header plate of claim 10 wherein R2 is at least equal to or greater than 2×R1.

12. The header plate of claim 10 wherein R2 is at least 3.0 mm.

13. A heat exchanger comprising:

a plurality of spaced, parallel, flattened tubes, each of the tubes having an exterior cross section defined by a pair of broad side walls joined by a pair of shorter nose walls; and a header plate comprising:

a planar base wall;

a plurality of tube receiving openings in the base wall, each of the openings surrounded by a flange extending from the base wall towards the core to surround the exterior cross section of a flattened tube received in the opening, the flange being shaped to conform to said exterior cross section and having a pair of long side walls that conform to the broad side walls of the flattened tube and a pair of short side walls that conform to the nose walls of the flattened tube, wherein a blend radius is provided at the interface between the flange and the base wall, the blend radius having a size that increases from a radius R1 central to the length of the long side walls to a radius R2 central to the length of the short side walls, with R2 being in the range of 1.25×R1 to 5×R1.

14. The header plate of claim 13 wherein R2 is at least equal to or greater than 2×R1.

15. The header plate of claim 13 wherein R2 is at least 3.0 mm.

16. A header plate for receiving the flattened tubes of a heat exchanger core, each of the flattened tubes having an exterior cross section defined by a pair of broad side walls joined by a pair of shorter nose walls, the header plate comprising:

a planar base wall; and a plurality of tube receiving openings in the base wall, each of the openings surrounded by a flange (collar) extending from the base wall towards the core to surround the exterior cross section of a flattened tube received in the opening, the flange being shaped to conform to said exterior cross section and having a pair of long side walls that conform to the broad side walls of the flattened tube and a pair of short side walls that conform to the nose walls of the flattened tube, wherein the broad side walls are flared away from each other as they extend away from the base wall and a blend radius R1 is provided at the interface between a central portion of each of the long side walls and the base wall, a blend radius R2 is provided at the interface between each of the short side walls and the base wall, and R2 is in the range of 1.25×R1 to 5×R1.

17. The header plate of claim 16 wherein R2 is at least equal to or greater than 2×R1.

18. The header plate of claim 16 wherein R2 is at least 3.0 mm.

19. The header plate of claim 16 wherein the base wall has a thickness of about 2.5 mm, the walls of the flange have a thickness of about 0.71 mm, R1 is about 1.5 mm, R2 is about 3 mm, and the flange has a height above the base wall in the range of about 7.0 mm to about 6.2 mm.

20. The header plate of claim 16 wherein a blend radius $R_T$ is provided at the interface between the base wall and portions of each of the long side walls adjacent the short side walls, the blend radius $R_T$ decreasing from R2 to R1 as the interface extends from corresponding short side wall toward the central portion of the corresponding long side wall.

21. A header plate for receiving the flattened tubes of a heat exchanger core, each of the flattened tubes having an exterior cross section defined by a pair of broad side walls joined by a pair of shorter nose walls, the header plate comprising:

a planar base wall; and a plurality of tube receiving openings in the base wall, each of the openings surrounded by a flange (collar) extending from the base wall towards the core to surround the exterior cross section of a flattened tube received in the opening, the flange being shaped to conform to said exterior cross section and having a pair of long side walls that conform to the broad side walls of the flattened tube and a pair of short side walls that conform to the nose walls of the flattened tube, wherein the broad side walls are flared away from each other as they extend away from the base wall and a blend radius is provided at the interface between the flange and the base wall, the blend radius having a size that increases from a radius R1 central to the length of the long side walls to a radius R2 central to the length of the short side walls, with R2 being in the range of 1.25×R1 to 5×R1.

22. The header plate of claim 21 wherein R2 is at least equal to or greater than 2×R1.

23. The header plate of claim 21 wherein R2 is at least 3.0 mm.

24. The header plate of claim 21 wherein the base wall has a thickness of about 2.5 mm, the walls of the flange have a thickness of about 0.71 mm, R1 is about 1.5 mm, R2 is about 3 mm, and the flange has a height above the base wall in the range of about 7.0 mm to about 6.2 mm.

25. A heat exchanger comprising:

a plurality of spaced, parallel, flattened tubes, each of the tubes having an exterior cross section defined by a pair of broad side walls joined by a pair of shorter nose walls; and a header plate comprising:

a planar base wall; and a plurality of tube receiving openings in the base wall, each of the openings surrounded by a flange (collar) extending from the base wall towards the core to surround the exterior cross section of a flattened tube received in the opening, the flange being shaped to conform to said exterior cross section and having a pair of long side walls that conform to the broad side walls of the flattened tube and a pair of short side walls that conform to the nose walls of the flattened tube, wherein the broad side walls are flared away from each other as they extend away from the base wall and a blend radius R1 is provided at the interface between a central portion of each of the long side walls and the base wall, a blend radius R2 is provided at the interface between each of the short side walls and the base wall, and R2 is in the range of 1.25×R1 to 5×R1.

26. The header plate of claim 25 wherein R2 is at least equal to or greater than 2×R1.

27. The header plate of claim 25 wherein R2 is at least 3.0 mm.

28. A heat exchanger comprising:

a plurality of spaced, parallel, flattened tubes, each of the tubes having an exterior cross section defined by a pair of broad side walls joined by a pair of shorter nose walls; and a header plate comprising:

a planar base wall;

a plurality of tube receiving openings in the base wall, each of the openings surrounded by a flange (collar) extending from the base wall towards the core to surround the exterior cross section of a flattened tube received in the opening, the flange being shaped to conform to said exterior cross section and having a pair of long side walls that conform to the broad side walls of the flattened tube and a pair of short side walls that conform to the nose walls of the flattened tube, wherein the broad side walls are flared away from each other as they extend away from the base wall and a blend radius is provided at the interface between the flange and the base wall, the blend radius having a size that increases from a radius R1 central to the length of the long side walls to a radius R2 central to the length of the short side walls, with R2 being in the range of 1.25×R1 to 5×R1.

29. The header plate of claim 28 wherein R2 is at least equal to or greater than 2×R1.

30. The header plate of claim 28 wherein R2 is at least 3.0 mm.

* * * * *